United States Patent [19]

van Hemmen et al.

[11] Patent Number: 4,986,011

[45] Date of Patent: Jan. 22, 1991

[54] CUTTING DEVICE WITH REMOVABLE TOOLS

[75] Inventors: Aldert J. M. van Hemmen; Cornelis M. P. Wempe; Martinus A. Balm, all of Spaarndam, Netherlands

[73] Assignee: Stapel B.V., Netherlands

[21] Appl. No.: 339,118

[22] Filed: Apr. 17, 1989

[51] Int. Cl.[5] ..... E02F 9/28

[52] U.S. Cl. ..... 37/141 T; 37/142 A; 299/92

[58] Field of Search ..... 299/92; 37/142 R, 142 A, 37/141 R, 141 T

[56] References Cited

U.S. PATENT DOCUMENTS

| | | | |
|---|---|---|---|
| 3,312,002 | 4/1967 | Benetti | 37/142 A |
| 3,729,845 | 5/1973 | Flippin | 37/142 A |
| 3,808,716 | 5/1974 | Verbeek | 37/142 R |
| 4,338,736 | 7/1982 | Radigan | 37/142 A |
| 4,611,418 | 9/1986 | Launder | 37/142 A |
| 4,748,754 | 6/1988 | Schwappach | 37/141 R |

FOREIGN PATENT DOCUMENTS

| | | | |
|---|---|---|---|
| 0015890 | 9/1980 | European Pat. Off. . | |
| 0025421 | 8/1981 | European Pat. Off. . | |
| 7610228 | 3/1978 | Netherlands . | |
| 7613933 | 5/1978 | Netherlands . | |
| 7802738 | 9/1978 | Netherlands . | |
| 7808654 | 3/1979 | Netherlands . | |
| 7808655 | 3/1979 | Netherlands . | |
| 7711824 | 5/1979 | Netherlands . | |
| 1292612 | 1/1970 | United Kingdom | 37/142 A |

*Primary Examiner*—Dennis L. Taylor
*Assistant Examiner*—Arlen L. Olsen
*Attorney, Agent, or Firm*—Stevens, Davis, Miller & Mosher

[57] ABSTRACT

Cutting device with a number of cutting tools which individually and replaceably are mounted upon a supporting edge, each tool being V-shaped with a short leg and a long leg. The space between said legs fits upon the tapered shape of said edge, each long leg extending into a bracket which is integral with the part having said edge and is located at a distance from said edge. Between said part and said long leg a deformable element is placed in a space formed between the bracket and the edge.

7 Claims, 2 Drawing Sheets

CUTTING DEVICE WITH REMOVABLE TOOLS

BACKGROUND OF THE PRIOR ART

The present invention relates to a cutting device, having at least one part with an edge provided with a plurality of replaceable cutting tools, in particular a cutting device of the type having a plurality of spirally extending cutter blades which extend from a circular base towards a common front part with openings between the blades, said blades being provided at their leading edges with a plurality of cutting tools which each are individually mounted upon said edges by means of detachable connecting elements.

Cutting devices of this type are well known in the art of dredging.

Examples are to be found in published patent applications EP-A-0 025 421, EP-A-0 015 890, NL-A-7711824 and NL-A-7808655.

According to said prior art cutting devices the cutting tools are mounted upon the edge portion of a part or a cutter blade through the intermediance of an adaptor which itself can be removably secured to the said edge portion of the said part or of the cutter blade or as most common, by means of welding.

The cutting tools often have to be replaced. Accordingly it is necessary that they can be easily removed.

The material of the cutting tools has to be hard and usually does have a hardness which is greater than the hardness of the adaptor or holder which adaptor has to be from a material which allows welding upon the said-part or cutter blade. Such a material does, however, have a wear resistance which is less than the wear resistance of the cutting tools. As a consequence it often becomes necessary to exchange the adaptors.

The tools must have a certain volume of material sufficient to avoid that, by being too small, exchange has to take place often. Large tools have a longer wearing time than small tools.

Tools mounted upon an adaptor require adaptors of sufficient strength and material volume to avoid that exchange has to take place too often.

Accordingly the adaptors partly block the openings between the cutting tools or between the blades and under certain dredging conditions the passage between the blades of e.g. a cutter head becomes too small and can become clogged with sticky materials, like clay and the like.

The prior art cutting devices which use adaptors or holders are expensive, difficult with respect to repair and maintenance.

Purpose of the invention is to provide a cutting device with cutting tools of sufficient volume and hardness, which cutting tools can be exchanged in a simple and fast way by using means which do not reduce the space between the cutting tools or blades respectively.

SHORT DESCRIPTION OF THE INVENTION

According to the invention the outer part of each edge has tapering side faces which extend towards a common imaginary section line outside said side faces, which side faces end in front of said section line, that the cutting tools have an integral body portion, which body portion in principal is V-shaped with a short leg and a long leg with the inner faces of said legs extending at substantially the same angle with respect to each other as the angle of the taper of the side faces of the said edges, which cutting tools are directly mounted with the inner faces of said legs upon the tapering side faces of the said part or blade, each long leg having at its end a lip portion which extends into the opening or recess of a support which forms an integral part with the said part or blade, which supports are spaced apart over the length of each part or blade at a distance from the edges of said part or blade, the shape of the inner face of the long leg of each tool body and the opposite face of the edge, between the tapered edge part and the support being such that a space is formed into which a deformable element can be placed in a direction which is substantially parallel to the said edge.

According to the invention the cutting tools now are directly mounted upon the said part or blade without making use of a special holder or adaptor. Each cutting tool is held in place by means of a deformable pin which insures that the long leg of the V-shaped tool body is held in place. To this end it is recommendable that the deformable element or pin is placed between an inwardly curved inner face of the long leg and an outwardly open curved opposite groove portion of the part or blade with the said edge. The deformable pin preferably is formed from a spirally wound metal strip. Such a pin itself is known in a different art such as for the simple the connection of a wheel upon a shaft.

By the fact that no adaptor is used anymore there accordingly is no space taken away by the adaptors and the flow space between the blades is no longer blocked or reduced by an adaptor.

The construction of the cutting device is simple because at the edge portion no special provisions are necessary for attaching an adaptor or holder by means of welding or by means of other attaching means. The only provision to be taken is a series of spaced apart supports which can be simple inverted U-shaped elements welded upon the side face of the said part or cutter blade. The tapering side faces of the edge of the said part or cutter blade are continuous side faces which can be ground or not.

Figure 1:
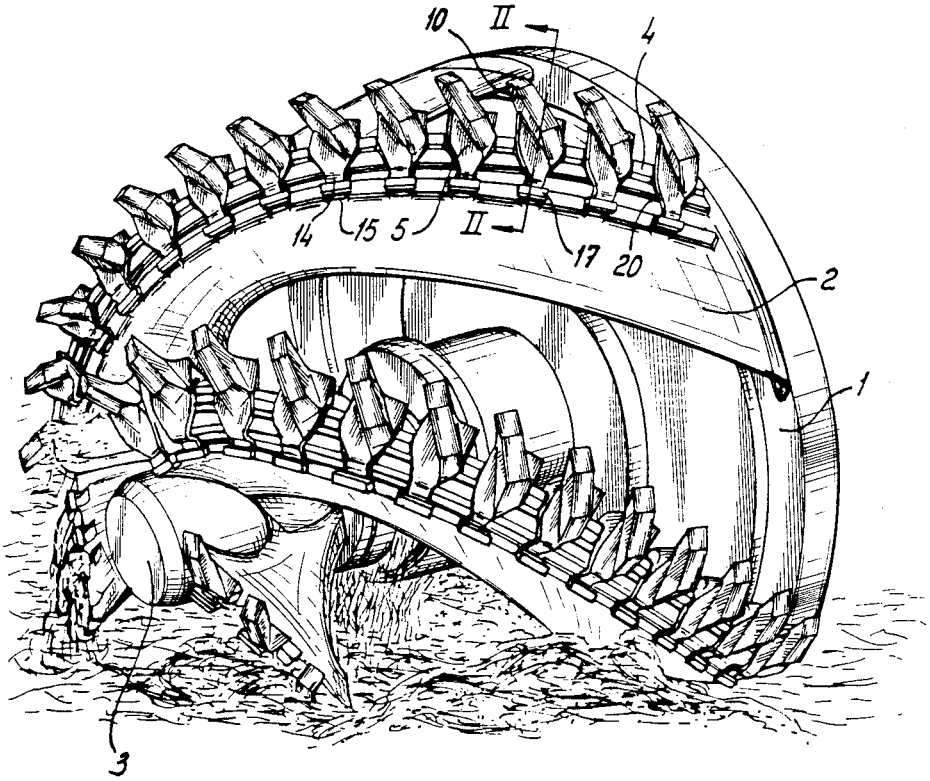
FIG. 1 is a perspective view of a cutter head according to the invention.

The cutter head shown in FIG. 1 has a circular base 1 and a plurality of spirally wound cutter blades 2 which extend towards a central outer hub portion 3. Each cutter blade 2 has a leading edge 4 upon which are mounted spaced apart cutting tools 5.

Figure 2:
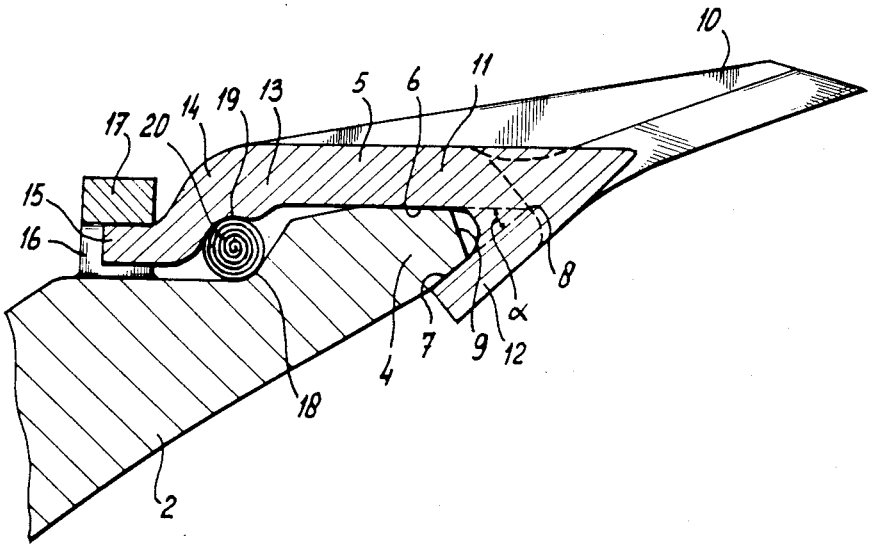
FIG. 2 is a cross section taken through a cutter blade according to the line II—II of FIG. 1.
Figure 3:
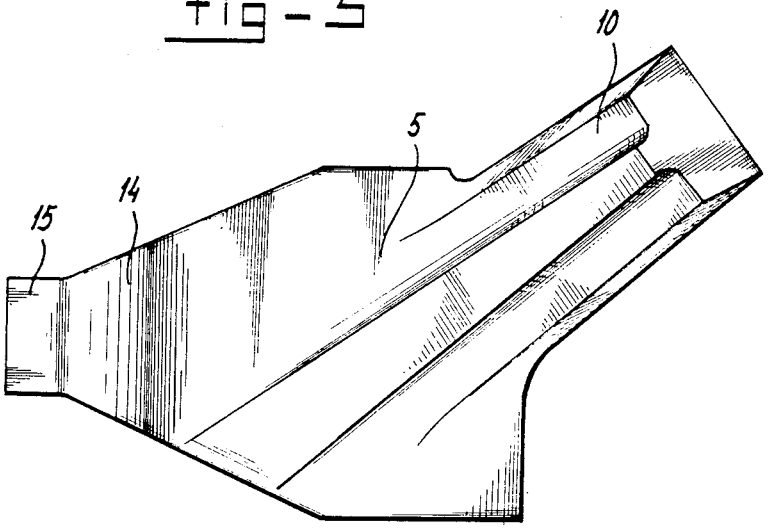
FIG. 3 is a top view of a cutting tool.

As more clearly shown in FIG. 2 each cutter blade 2 has a leading edge 4 with side faces 6 and 7 which taper outwardly starting from an imaginary section line indicated with 8, which tapering side faces 6 end 7 and in front of said section line by the outer face 9.

Each cutting tool has a tooth portion 10 and a body portion 11 which body portion in principle is V-shaped and comprises a short leg 12 and a long leg 13.

Part of the inner faces of the legs 12 and 13 extend at substantially the same tapering angle $\alpha$ with respect to each other as the faces 6 and 7 of the leading edge of each cutter blade. Accordingly said V-shaped legs with their inner opening fit upon the leading edges of the cutter blades.

To obtain a removable attachment of each cutting tool 5 the long leg 13 has an extension 14 which is in the example shown slightly curved inwardly and ends in a lip portion 15 which extends into the opening 16 of an inverted U-shaped support 17 or bracket.

As can be seen from FIG. 1 each blade has a plurality of spaced apart supports 17 which are mounted upon the outer face of each cutter blade in a row which extends parallel to the outer end face 9 of the cutter blade.

The cutter blade at a distance from the tapering side faces 6 and 7 has been provided with a recess 18.

Between the inner curved side 19 of the extension 14 of the long leg of the cutting tool and the recess 18 a deformable element 20 has been placed in the form of a pin which as shown is formed from a closely wound strip of metal, such as soft steel. By means of said deformable element 20 each cutting tool is held not only with its lip portion 15 against the support 17 but is also prevented from moving out of the support and away from the outer edge of the cutting blade (to the right in FIG. 2).

It is easy to understand that mounting and dismounting is a simple operation. For mounting the tools are simply placed upon the outer edge 4 of the cutter blade 2 with the lip 15 in the opening 16 of the support 17. The deformable element 20 is then placed and hammered in place to obtain a rigid connection.

For replacement the deformable element 20 is simply removed by hammering it out of its place.

It is also easy to understand that the cutter blades of the cutter head do not require much space or, with other words, do not reduce the space between the blades which space has to be a maximum, because through said space the material cut loose by the tools has to pass to enter the not shown but well known in the art suction tube of the dredger.

It is also easy to understand that the cutting tools have a simple shape. They can be cast or forged from the required steel having wear resistant qualities as desired. The inner V-shaped faces of the tools and the outer V-shaped faces of the cutter blade need not to be machined accurately but, if desired, this easily can be achieved.

The cutter blades 2 can now be manufactured from a more wear resistant material, because it is not necessary to weld upon the edge portion a plurality of adaptors or holders.

We claim:

1. Cutting device having at least one part with an edge provided with a plurality of replaceably cutting tools, each of which are individually mounted upon said edge by means of detachably connecting elements, the improvement comprising:

the outer part of each edge having tapering side faces which extend towards a common imaginary section line outside said side faces, which side faces terminate short of said section line, the cutting tools having an integral body which is generally V-shaped with a short leg and a long leg with the inner faces of said legs extending at substantially the same angle with respect to each other as the angle of the taper of the side faces of said edge part, said cutting tools being directly mounted with the inner faces of said legs upon the tapering side faces of the said edge, said edge part having a plurality of integral supports spaced apart along the length of said edge part at a distance from the edge thereof, each having an opening or recess, each long leg having at its end a lip portion which extends into the opening or recess of one of said integral supports, the shape of the inner face of the long leg of each tool body and the opposing face of the edge part being such that a space is formed therebetween, said space being positioned between the support and the tapering side faces of the edge part so that a deformable element can be placed in said space in a direction which is substantially parallel to the edge of said edge part.

2. Cutting device as claimed in claim 1 wherein the cutting device is a rotatable cutter head of the type having a plurality of spirally extending cutter blades which extend from a circular base towards a common front part with openings between the blades, which blades each are the said parts with the tapering edge upon which the cutting tools are detachably secured, which blades each have said plurality of integral supports in the form of a row of spaced apart inverted U-shaped supports adapted to receive the lip portion of the long leg of a tool.

3. Cutter head as claimed in claim 2 wherein the deformable element is a pin.

4. Cutter head as claimed in claim 2 wherein the long leg of the V-shaped tool body between the lip portion and the inner face which engages the opposite tapering face of the edge portion of the cutter blade has an inwardly curved part, whereas the cutter blade between the edge portion and the support has an inwardly curved portion with a recess opposite said inwardly curved portion of the long leg of the tool body which recess and inwardly curved portion form the space into which the deformable element is placed, said recess and curved portion forming shoulders by means of which the deformable element tensions the v-shaped inner faces of the tool bodies against the opposing outer faces of the edge portion of the cutter blade.

5. Cutter head as claimed in claim 1 wherein the deformable element is a pin.

6. Cutter head as claimed in claim 5 wherein the pin is formed from a spirally wound metal strip.

7. Cutter head as claimed in claim 1 wherein the long leg of the V-shaped tool body between the lip portion and the inner face which engages the opposite tapering face of the edge portion of the cutter blade has an inwardly curved part, whereas the cutter blade between the edge portion and the support has an inwardly curved portion with a recess opposite said inwardly curved portion of the long leg of the tool body which recess and inwardly curved portion form the space into which the deformable element is placed, said recess and curved portion forming shoulders by means of which the deformable element tensions the V-shaped inner faces of the tool bodies against the opposing outer faces of the edge portion of the cutter blade.

* * * * *